US007288031B2

(12) United States Patent
Watanabe et al.

(10) Patent No.: US 7,288,031 B2
(45) **Date of Patent: *Oct. 30, 2007**

(54) GOLF BALL

(75) Inventors: Hideo Watanabe, Chichibu (JP); Junji Hayashi, Chichibu (JP); Rinya Takesue, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/274,166

(22) Filed: Nov. 16, 2005

(65) Prior Publication Data

US 2006/0063612 A1 Mar. 23, 2006

Related U.S. Application Data

(63) Continuation of application No. 10/765,088, filed on Jan. 28, 2004.

(51) Int. Cl.
*A63B 37/06* (2006.01)

(52) U.S. Cl. ..... 473/374

(58) Field of Classification Search ..... 473/373, 473/374, 378, 376, 377

See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,830,085 | A | 11/1998 | Higuchi et al. | |
| 5,935,022 | A * | 8/1999 | Sugimoto et al. | 473/373 |
| 5,967,908 | A | 10/1999 | Yamagishi et al. | |
| 6,213,896 | B1 * | 4/2001 | Higuchi et al. | 473/374 |
| 6,514,158 | B1 * | 2/2003 | Nakamura et al. | 473/378 |
| 6,558,275 | B2 | 5/2003 | Ohama | |
| 6,561,925 | B2 | 5/2003 | Watanabe et al. | |
| 2001/0016522 | A1 * | 8/2001 | Watanabe et al. | 473/371 |
| 2001/0031669 | A1 * | 10/2001 | Ohama | 473/371 |
| 2004/0198534 | A1 * | 10/2004 | Sasaki | 473/370 |

FOREIGN PATENT DOCUMENTS

| | | | |
|---|---|---|---|
| JP | 09-313643 | A | 12/1997 |
| JP | 10-305114 | A | 11/1998 |
| WO | WO98/46671 | A1 | 10/1998 |

* cited by examiner

*Primary Examiner*—Raeann Trimiew
(74) *Attorney, Agent, or Firm*—Sughrue Mion Pllc.

(57) ABSTRACT

A golf ball comprising a core, an intermediate layer, and a cover exhibits a good profile of rebound, feel and durability suited for low head speed amateur players when it satisfies the requirements that (Shore D hardness of the cover)−(Shore D hardness of the intermediate layer)>0, (initial velocity (in m/s) of the core enclosed with the intermediate layer)−(initial velocity (in m/s) of the core)>0, 0.90≦(Deflection amount of the core enclosed with the intermediate layer)/(Deflection amount of the core)≦1.00, and the total thickness (in mm) of the intermediate layer and the cover is up to 3.0 mm.

38 Claims, No Drawings

GOLF BALL

CROSS REFERENCE TO RELATED APPLICATION

This is a continuation application based on parent application Ser. No. 10/765,088 filed Jan. 28, 2004. The entire disclosure of the prior application is considered part of the disclosure of the accompanying continuation application and is hereby incorporated by reference.

BACKGROUND OF THE INVENTION

1. Technical Field

This invention relates to a golf ball having a good profile of rebound, feel and durability suited for low head speed amateur players to play.

2. Prior Art

With the currently increasing population of golfers, the requirements on golf balls have been diversified and personalized. Golf balls have hitherto been modified and improved in a variety of ways to address such requirements of golfers.

For example, JP-A 9-313643 discloses a golf ball comprising a core, intermediate layer and cover which has optimized the hardness distribution of the core and the hardness distribution of the entire ball, thus simultaneously satisfying all requirements including excellent flight performance, durability, a good feel on impact and controllability. Also, JP-A 10-305114 describes a golf ball comprising a solid core, intermediate layer and cover, the cover having a plurality of dimples formed on a surface thereof, which has optimized the hardness balance among the core, intermediate layer and cover and the parameters of dimples, thereby improving the feel on impact and flight performance independent of head speed.

However, these golf balls are still insufficient in rebound. There is a need for golf balls that satisfy all properties of rebound, feel and durability on use by amateur players who swing at low head speeds.

SUMMARY OF THE INVENTION

An object of the invention is to provide a golf ball having a good profile of rebound, feel and durability suited for low head speed amateur players.

The invention pertains to a golf ball comprising a core, an intermediate layer enclosing the core to form a sphere, and a cover enclosing the intermediate layer. It has been found that when the balance of Shore D hardness between the intermediate layer and the cover, the balance of initial velocity between the core and the sphere, and the balance of Deflection amount between the core and the sphere are optimized, and the total thickness of the intermediate layer and the cover is properly selected, the golf ball is given a good profile of rebound, feel and durability suited for low head speed amateur players to play. The present invention is predicated on this finding.

Accordingly, the present invention provides a golf ball comprising a core, an intermediate layer enclosing the core to form a sphere, and a cover enclosing the intermediate layer, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4):

(1) (Shore D hardness of the cover)−(Shore D hardness of the intermediate layer)>0, (2) (initial velocity of the sphere)−(initial velocity of the core)>0, (3) 0.90≦(Deflection amount of the sphere)/(Deflection amount of the core)≦1.00, and (4) the total of the thickness of the intermediate layer and the thickness of the cover is up to 3.0 mm.

The preferred golf ball further satisfies the following requirements (5) to (9):

(5) the thickness of the cover is from 0.5 mm to 2.0 mm, (6) the Shore D hardness of the cover is from 55 to 70, (7) the thickness of the intermediate layer is from 0.5 mm to 1.6 mm, (8) the Shore D hardness of the intermediate layer is from 40 to 60, and (9) the golf ball has an initial velocity of at least 76.5 m/s.

In a preferred embodiment, the golf ball further satisfies the following requirement (10):

(10) the cover has a melt flow rate of at least 2 g/10 min.

In a further preferred embodiment, the golf ball further satisfies the following requirement (11):

(11) 0.85≦(Deflection amount of the golf ball)/(Deflection amount of the sphere)≦0.95.

In the preferred golf ball, the intermediate layer comprises (A) an ionomer resin comprising (a-1) an olefin/unsaturated carboxylic acid binary random copolymer and/or a metal ion neutralized product thereof and (a-2) an olefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-monomeric thermoplastic elastomer in a weight ratio A/B between 100/0 and 50/50.

More preferably, the intermediate layer is made of a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in the resin component and component (C).

The golf ball of the invention exhibits a good profile of rebound, feel and durability when low head speed amateur players play with it.

DESCRIPTION OF THE PREFERRED EMBODIMENTS

The golf ball of the invention comprises a core, an intermediate layer enclosing the core to form a sphere, and a cover enclosing the intermediate layer. The ball satisfies the following requirements (1) to (4):

(1) (Shore D hardness of the cover)−(Shore D hardness of the intermediate layer)>0, (2) (initial velocity (in m/s) of the sphere)−(initial velocity (in m/s) of the core)>0, (3) 0.90≦[(Deflection amount of the sphere)/(Deflection amount of the core)]≦1.00, and (4) the total of the thickness (in mm) of the intermediate layer and the thickness (in mm) of the cover is equal to or less than 3.0 mm.

As used herein, the term "sphere" means the core enclosed with the intermediate layer unless otherwise stated.

As used herein, the "Deflection amount" is defined as the amount of deflection or deformation (in mm) under load of a spherical body incurred when the load is increased from an initial value of 98 N (10 kgf) to a final value of 1275 N (130 kgf). The term "spherical body" is used to include the core, the sphere and the ball.

Intermediate Layer and Cover

The intermediate layer and/or the cover is preferably formed of a material which comprises (A) an ionomer resin comprising (a-1) an olefin/unsaturated carboxylic acid binary random copolymer and/or a metal ion neutralized olefin/unsaturated carboxylic acid binary random copolymer and (a-2) an olefin/unsaturated carboxylic acid/unsaturated carboxylic acid ester ternary random copolymer and/or a metal ion neutralized olefin/unsaturated carboxylic acid/unsaturated carboxylic acid ester ternary random copolymer in a weight ratio (a-1)/(a-2) between 100/0 and 0/100, and (B) a non-ionomeric thermoplastic elastomer in a weight ratio A/B between 100/0 and 50/50; and more preferably a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in the resin component and component (C).

The olefins in components (a-1) and (a-2) have a number of carbon atoms that is generally at least 2, but not more than 8, and preferably not more than 6. Specific examples of olefins include ethylene, propylene, butene, pentene, hexene, heptene and octene. Ethylene is especially preferred.

Suitable examples of the unsaturated carboxylic acid include acrylic acid, methacrylic acid, maleic acid and fumaric acid. Acrylic acid and methacrylic acid are especially preferred.

The unsaturated carboxylic acid esters in component (a-2) include lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, isobutyl acrylate) is especially preferred.

The olefin/unsaturated carboxylic acid binary random copolymer of component (a-1) and the olefin/unsaturated carboxylic acid/unsaturated carboxylic acid ester ternary random copolymer of component (a-2) (the copolymers are collectively referred to as "random copolymers," hereinafter) can each be obtained by suitably formulating the above-described olefin, unsaturated carboxylic acid and optional unsaturated carboxylic acid ester and carrying out random copolymerization in a conventional manner.

It is recommended that the random copolymers be prepared such as to have a specific unsaturated carboxylic acid content (sometimes referred to as the "acid content," hereinafter). The amount of unsaturated carboxylic acid included within the random copolymer of component (a-1) is generally at least 4 wt %, preferably at least 6 wt %, more preferably at least 8 wt %, and most preferably at least 10 wt %, but generally not more than 30 wt %, preferably not more than 20 wt %, more preferably not more than 18 wt %, and most preferably not more than 15 wt %. Similarly, the amount of unsaturated carboxylic acid included within the random copolymer of component (a-2) is generally at least 4 wt %, preferably at least 6 wt %, and more preferably at least 8 wt %, but not more than 15 wt %, preferably not more than 12 wt %, and more preferably not more than 10 wt %. If the random copolymer of component (a-1) and/or (a-2) has too low an acid content, resilience may decline. Too high an acid content may lower processability.

The metal ion neutralized product of an olefin/unsaturated carboxylic acid binary random copolymer in component (a-1) and the metal ion neutralized product of an olefin/unsaturated carboxylic acid/unsaturated carboxylic acid ester ternary random copolymer in component (a-2) (the metal ion neutralized products of such copolymers are collectively referred to as "metal ion-neutralized random copolymers," hereinafter) can each be obtained by neutralizing some or all of the acid groups on the random copolymer with metal ions.

Illustrative examples of metal ions for neutralizing the acid groups on the random copolymer include $Na^+$, $K^+$, $Li^+$, $Zn^{2+}$, $Cu^{2+}$, $Mg^{2+}$, $Mg^{2+}$, $Ca^{2+}$, $Co^{2+}$, $Ni^{2+}$ and $Pb^{2+}$. Preferred metal ions are $Na^+$, $Li^+$, $Zn^{2+}$ and $Mg^{2+}$. The use of $Na^+$ is especially recommended for improved resilience.

The metal ion-neutralized random copolymers may be prepared by neutralization with such metal ions. For example, formates, acetates, nitrates, carbonates, bicarbonates, oxides, hydroxides or alkoxides of the above metal ions are added to the acid group-bearing random copolymers to neutralize acid groups. The degree of neutralization of the random copolymer with metal ions is not particularly limited.

Commercial products may be used as components (a-1) and (a-2). Exemplary commercial products that may be used as the random copolymer in component (a-1) include Nucrel 1560, Nucrel 1214 and Nucrel 1035 (DuPont-Mitsui Polychemicals Co., Ltd.), and Escor 5200, Escor 5100 and Escor 5000 (ExxonMobil Chemical).

Exemplary commercial products that may be used as the metal ion-neutralized random copolymer in component (a-1) include Himilan 1554, Himilan 1557, Himilan 1601, Himilan 1605, Himilan 1706 and Himilan AM7311 (DuPont-Mitsui Polychemicals Co., Ltd.), Surlyn 7930 (E.I. du Pont de Nemours and Co., Inc.) and Iotek 3110 and Iotek 4200 (ExxonMobil Chemical).

Exemplary commercial products that may be used as the random copolymer in component (a-2) include Nucrel AN4311 and Nucrel AN4318 (DuPont-Mitsui Polychemicals Co., Ltd.), and Escor ATX325, Escor ATX320 and Escor ATX310 (ExxonMobil Chemical).

Exemplary commercial products that may be used as the metal ion-neutralized random copolymer in component (a-2) include Himilan 1855, Himilan 1856 and Himilan AM7316 (DuPont-Mitsui Polychemicals Co., Ltd.), Surlyn 6320, Surlyn 8320, Surlyn 9320 and Surlyn 8120 (E.I. du Pont de Nemours and Co., Inc.), and Iotek 7510 and Iotek 7520 (ExxonMobil Chemical).

The random copolymers and metal ion-neutralized random copolymers may be used alone or in admixture of any as each component (a-1) or (a-2). Examples of sodium-neutralized ionomer resins which are preferred as the metal ion-neutralized random copolymers include Himilan 1605, Himilan 1601 and Surlyn 8120.

Component (a-2) generally accounts for greater than or equal to 0 wt % (% by weight), preferably greater than or equal to 50 wt % of the total weight of components (a-1) and (a-2) while the upper limit of component (a-2) content is generally less than or equal to 100 wt %.

Component (B) is a non-ionomeric thermoplastic elastomer which is preferably included to further enhance both the feel of the golf ball upon impact and its rebound characteristics. In this disclosure, the ionomer resin (A) and non-ionomeric thermoplastic elastomer (B) are collectively referred to as the "resin component."

Specific examples of the non-ionomeric thermoplastic elastomer (B) include olefinic elastomers, styrenic elastomers, polyester elastomers, urethane elastomers and polyamide elastomers. Of these, olefinic elastomers and polyester elastomers are preferred for further increasing resilience.

Commercial products may be used as component (B). An exemplary olefinic elastomer is Dynaron (JSR Corporation) and an exemplary polyester elastomer is Hytrel (DuPont-Toray Co., Ltd.). They may be used alone or in admixture.

Component (B) generally accounts for greater than or equal to 0 wt %, preferably greater than or equal to 20 wt % based on the total weight of the resin component while the upper limit of component (B) content is generally less than or equal to 50 wt %, preferably less than or equal to 40 wt %. If the content of component (B) in the resin component is more than 50 wt %, the respective components may become less compatible, resulting in golf balls with a drastic decline of durability.

Component (C) is an organic fatty acid and/or fatty acid derivative having a molecular weight of 280 to 1,500. This component is advantageously included because its molecular weight is very low compared to the resin component and it is effective to adjust the melt viscosity of the mixture to a suitable level, particularly to help improve flow.

The molecular weight of the organic fatty acid or fatty acid derivative (C) is generally at least 280, preferably at least 300, more preferably at least 330, and most preferably at least 360, but not more than 1,500, preferably not more than 1,000, more preferably not more than 600, and most preferably not more than 500. Too low a molecular weight may lead to poor heat resistance whereas too high a molecular weight may fail to improve flow.

Preferred examples of the organic fatty acid (C) include unsaturated organic fatty acids having a double bond or triple bond on the alkyl group, and saturated organic fatty acids in which all the bonds on the alkyl group are single bonds. It is recommended that the number of carbons on the organic fatty acid molecule be generally at least 18, preferably at least 20, more preferably at least 22, and most preferably at least 24, but up to 80, preferably up to 60, more preferably up to 40, and most preferably up to 30. Too few carbons may lead to poor heat resistance and may also make the content of acid groups relatively high so as to diminish the flow-enhancing effect on account of excessive interactions with acid groups in the resin component. On the other hand, too many carbons increases the molecular weight, which may prevent the significant flow-enhancing effect from being achieved.

Specific examples of organic fatty acids that may be used as component (C) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Organic fatty acid derivatives which may be used as component (C) include metallic soaps in which the proton on the acid group of the above organic fatty acid is substituted with a metal ion. Metal ions that may be used in such metallic soaps include $Na^+$, $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of organic fatty acid derivatives that may be used as component (C) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. They may be used alone or in admixture of any.

The amount of component (C) included is generally at least 5 parts by weight (pbw), preferably at least 10 pbw, more preferably at least 15 pbw, and most preferably at least 18 pbw, per 100 pbw of the resin component (i.e., A+B). The upper limit of component (C) amount is generally up to 80 pbw, preferably up to 40 pbw, more preferably up to 25 pbw, and most preferably up to 22 pbw per 100 pbw of the resin component. Too small an amount of component (C) included may lead to a very low melt viscosity and hence, poor processability whereas too large an amount of component (C) may adversely affect durability.

It is noted that known metallic soap-modified ionomers, including those described in U.S. Pat. No. 5,312,857, U.S. Pat. No. 5,306,760 and International Application WO 98/46671, may be used as the combination of ionomer resin (A) with component (C).

Component (D) is a basic inorganic metal compound which can neutralize un-neutralized acid groups in the resin component and component (C). If a metallic soap-modified ionomer resin is used alone without including component (D), for example, the metallic soap and the un-neutralized acid groups present on the ionomer resin undergo exchange reactions during heat mixing, generating a large amount of fatty acid which will readily vaporize. The fatty acid thus generated can cause problems to molded parts, for example, molded parts having defects, poor adhesion of paint film, and low rebound. To avoid such problems, component (D) is advantageously included.

Preferred component (D) is a basic inorganic metal compound which is highly reactive with the resin component and forms reaction by-products devoid of organic acids.

Illustrative examples of the metal ions in the basic inorganic metal compound (D) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$. These metal ions may be used alone or in admixture of any. Known basic inorganic fillers containing these metal ions may be used as the basic inorganic metal compound (D). Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. Inter alia, hydroxides and monoxides are recommended. Calcium hydroxide and magnesium oxide are especially preferred because they have a high reactivity with the resin component.

The amount of basic inorganic metal compound (D) included is generally at least 0.1 part by weight (pbw), preferably at least 0.5 pbw, more preferably at least 1 pbw, and most preferably at least 2 pbw, per 100 pbw of the resin component (i.e., A+B). As to the upper limit, the amount of component (D) is generally up to 10 pbw, preferably up to 8 pbw, more preferably up to 6 pbw, and most preferably up to 5 pbw per 100 pbw of the resin component. Too small an amount of component (D) included may fail to achieve improvements in thermal stability and resilience whereas too large an amount of component (D) may rather adversely affect the heat resistance of a golf ball material.

It is generally recommended that the mixture formulated by combining components (A) to (D) have a degree of neutralization which is at least 50 mol %, preferably at least 60 mol %, more preferably at least 70 mol %, and most preferably at least 80 mol %, based on the entire amount of acid groups in the mixture. The mixture with such a high degree of neutralization offers the advantage that even on use of a metal soap-modified ionomer resin, for example, the exchange reactions between the metal soap and un-neutralized acid groups in the ionomer resin during heat mixing are retarded, thus minimizing the risk of compromising the thermal stability, moldability and resilience of the mixture.

In addition to the aforementioned components (A) to (D), the material of which the intermediate layer and/or the cover is made in the practice of the invention may further include such additives as pigments, dispersants, antioxidants, ultraviolet absorbers and light stabilizers. Such additives may be incorporated in any desired amounts. The amount of additive is typically at least 0.1 pbw, preferably at least 0.5 pbw, more preferably at least 1 pbw per 100 pbw of the resin component (i.e., A+B). As to the upper limit, the amount of additive is typically up to 10 pbw, preferably up to 6 pbw, more preferably up to 4 pbw per 100 pbw of the resin component.

The material for the intermediate layer and/or the cover can be prepared by combining the essential and optional components described above, heating and mixing them together. For example, they are mixed on an internal mixer such as a kneading-type twin-screw extruder, a Banbury mixer or a kneader while heating at a temperature of 150 to 250° C.

Core

The core in the inventive golf ball may be either a thread-wound core or a solid core and may be produced by a conventional method.

For example, a solid core can be produced from a rubber composition comprising 100 parts by weight of cis-1,4-polybutadiene; from 10 to 60 parts by weight of one or more crosslinking agents selected from among α,β-monoethylenically unsaturated carboxylic acids (e.g., acrylic acid, methacrylic acid) or metal ion-neutralized compounds thereof and functional monomers (e.g., trimethylolpropane methacrylate); from 5 to 30 parts by weight of a filler such as zinc oxide or barium sulfate; from 0.5 to 5 parts by weight of a peroxide such as dicumyl peroxide; and, if necessary, from 0.1 to 1 part by weight of an antioxidant. The rubber composition may be formed into a solid spherical core by press vulcanization to effect crosslinkage, followed by compression under heating at 140 to 170° C. for a period of 10 to 40 minutes.

The core usually has a Deflection amount of at least 3.0 mm, preferably at least 3.3 mm, and more preferably at least 3.6 mm. As to the upper limit, Deflection amount of the core is usually up to 6.0 mm, preferably up to 5.0 mm, and more preferably up to 4.6 mm. A core with a Deflection amount of less than 3.0 mm may cause the golf ball to receive more spin and thus travel a shorter distance and to give a hard feel upon impact. On the other hand, a core with a Deflection amount of more than 6.0 mm may be less resilient so that the ball may have a shorter distance of travel and too soft a feel and be less durable to cracking upon repeated. impact.

Also the core usually has a specific gravity of at least 1.05 g/cm$^3$, preferably at least 1.15 g/cm$^3$ . As to the upper limit, the core usually has a specific gravity of up to 1.35 g/cm$^3$, preferably up to 1.25 g/cm$^3$.

Regarding core surface hardness, the core usually has a Shore D hardness of at least 30, preferably at least 35, and more preferably at least 40. As to the upper limit, the core usually has a Shore D hardness of up to 60, preferably up to 55, and more preferably up to 50. If the Shore D hardness on the core surface is more than 60, the feel on impact of the ball may become hard. If the Shore D hardness on the core surface is less than 30, the ball may have low rebound, a shorter flight, too soft a feel on impact, and poor durability to cracking upon repeated impact. Desirably, the core surface hardness is lower than the intermediate layer hardness. If the core surface is harder than the intermediate layer surface, the flight distance may become shorter due to more spin.

While it is recommended that the core, the intermediate layer and the cover of the inventive golf ball be formed of the above-described materials, respectively, the invention intends to provide a golf ball having a good profile of rebound, feel and durability suited for low-head-speed amateur players by optimizing the balance of Shore D hardness between the intermediate layer and the cover as specified by requirement (1), the balance of initial velocity between the core and the sphere as specified by requirement (2), and the balance of Deflection amount between the core and the sphere as specified by requirement (3), and properly selecting the total thickness of the intermediate layer and the cover as specified by requirement (4). The ball should satisfy the following requirements (1) to (4).

(1) (Shore D hardness of the cover)−(Shore D hardness of the intermediate layer)>0

(2) (initial velocity (in m/s) of the sphere)−(initial velocity (in m/s) of the core)>0

(3) 0.90≦(Deflection amount of the sphere)/(Deflection amount of the core)≦1.00

(4) The total of the thickness (in mm) of the intermediate layer and the thickness (in mm) of the cover is equal to or less than 3.0 mm.

In order to enhance the advantages, the golf ball should desirably satisfy the following requirements (5) to (11).

(5) The thickness (in mm) of the cover is from 0.5 mm to 2.0 mm.

(6) The Shore D hardness of the cover is from 55 to 70.

(7) The thickness (in mm) of the intermediate layer is from 0.5 mm to 1.6 mm.

(8) The Shore D hardness of the intermediate layer is from 40 to 60.

(9) The golf ball has an initial velocity of at least 76.5 m/s.

(10) The cover has a melt flow rate (MFR) of at least 2 g/10 min.

(11) 0.85≦(Deflection amount of the golf ball)/(Deflection amount of the sphere)≦0.95.

Regarding Requirement (1):

In the inventive golf ball, the difference of the Shore D hardness of the cover minus the Shore D hardness of the intermediate layer is more than 0, preferably at least 5, and more preferably at least 10, but up to 30, preferably up to 20, and more preferably up to 15. If the difference is 0 or negative, the flight distance becomes short due to more spin receptivity. If the difference is more than 30, the flight distance may become short due to less rebound.

Regarding Requirement (2):

In the inventive golf ball, the difference of the initial velocity (in m/s) of the sphere minus the initial velocity (in m/s) of the core is more than 0, preferably at least 0.1, more preferably at least 0.2. If the difference is 0 or negative, the flight distance becomes short due to less rebound. The effective means for meeting requirement (2) is to form the intermediate layer from a highly resilient material. Making the intermediate layer harder and the core softer and less resilient is likely to meet requirement (2), but this means alone fails to achieve the advantages of the invention unless the remaining requirements are met at the same time.

It is noted that the "initial velocity" (in m/s) is measured using the same type of initial velocity instrument as the drum rotation instrument approved by the United States Golf Association (USGA). The balls were conditioned in an environment of 23±1° C. for more than 3 hours before they were tested in a room at a temperature of 23±2° C. Using a club with a head having a striking mass of 250 pounds (113.4 kg), the balls were hit at a head speed of 143.8 ft/s (43.83 m/s). A dozen of balls were hit each four times while the time for passage over a distance of 6.28 feet (1.91 m) was measured, from which the initial velocity (m/s) was computed. This cycle was completed within about 15 minutes.

Regarding Requirement (3):

In the inventive golf ball, the ratio of the Deflection amount of the sphere to the Deflection amount of the core is at least 0.90, preferably at least 0.92, and more preferably at least 0.94. As to the upper limit, the ratio is up to 1, preferably up to 0.98, and more preferably up to 0.96. A Deflection amount ratio of less than 0.90 leads to a hard feel when hit with a putter, and more spin and a resultant shorter travel distance when hit with a driver (W#1). A ratio of more than 1 leads to more spin and a resultant shorter travel distance when hit with a driver (W#1), and low durability against repeated impact.

The effective means for designing the golf ball so as to meet requirement (3) is to provide the intermediate layer with a Shore D hardness in a range of about 40 to about 60 and set the thickness of the intermediate layer and the hardness of the core in appropriate ranges.

Regarding Requirement (4):

In the inventive golf ball, the total of the thickness (in mm) of the intermediate layer and the thickness (in mm) of the cover is up to 3.0 mm, preferably up to 2.8 mm, and more preferably up to 2.6 mm. As to the lower limit, the total thickness is preferably at least 1.5 mm, more preferably at least 2.0 mm, even more preferably at least 2.4 mm. A total thickness of more than 3.0 mm leads to more spin and a resultant shorter travel distance when hit with a driver (W#1). A total thickness of less than 1.5 mm may lead to low durability against repeated impact.

Regarding Requirement (5):

In the inventive golf ball, the thickness (in mm) of the cover is usually at least 0.5 mm, preferably at least 0.9 mm, and more preferably at least 1.1 mm. As to the upper limit, the cover thickness is usually up to 2.0 mm, preferably up to 1.6 mm, and more preferably up to 1.3 mm. A cover thickness of less than 0.5 mm may lead to low durability against repeated impact. A cover thickness of more than 2.0 mm may worsen the feel on approach and putter shots.

Regarding Requirement (6):

In the inventive golf ball, the Shore D hardness of the cover is usually at least 55, preferably at least 57, and more preferably at least 60. As to the upper limit, the cover Shore D hardness is usually up to 70, preferably up to 66, and more preferably up to 63. A cover Shore D hardness of less than 55 may lead to a shortage of travel distance due to more spin or poor rebound, and poor scuff resistance. A cover Shore D hardness of more than 70 may lead to poor durability to cracking upon repeated impact and worsen the feel on impact in what the golfers refer to as "short game" and on putter shots.

Regarding Requirement (7):

In the inventive golf ball, the thickness (in mm) of the intermediate layer is usually at least 0.5 mm, preferably at least 0.8 mm, and more preferably at least 1.1 mm. As to the upper limit, the intermediate layer thickness is usually up to 1.6 mm, preferably up to 1.4 mm, and more preferably up to 1.3 mm. An intermediate layer thickness of less than 0.5 mm may lead to low durability to cracking upon repeated impact and a shorter travel distance due to low rebound. An intermediate layer thickness of more than 1.6 mm may lead to more spin and a resultant shorter travel distance when hit with a driver (W#1).

Regarding Requirement (8):

In the inventive golf ball, the Shore D hardness of the intermediate layer, which means sheet hardness of the material constructing intermediate layer, is usually at least 40, preferably at least 45, and more preferably at least 48. As to the upper limit, the intermediate layer Shore D hardness is usually up to 60, preferably up to 55, and more preferably up to 52. An intermediate layer Shore D hardness of less than 40 may lead to a shortage of travel distance due to more spin or poor rebound. An intermediate layer Shore D hardness of more than 60 may lead to poor durability to cracking upon repeated impact and worsen the feel on short-game and putter shots.

Regarding Requirement (9):

The inventive golf ball has an initial velocity of usually at least 76.5 m/s, preferably at least 76.8 m/s, and more preferably at least 77.0 m/s. As to the upper limit, the initial velocity is generally up to 77.724 m/s. With too low an initial velocity, the flight distance may become shorter. Beyond the upper limit of 77.724 m/s, which is outside the standard of the USGA, the balls cannot be registered as being authorized.

Regarding Requirement (10):

In the inventive golf ball, the cover material has a melt flow rate (MFR) of usually at least 2 g/10 min, preferably at least 2.5 g/10 min, and more preferably at least 3.0 g/10 min. A material with an MFR of less than 2 g/10 min may be difficult to mold or be molded into balls which have poor sphericity and vary in flight performance. As used herein, the melt flow rate (MFR) is measured according to JIS K6760 at a temperature of 190° C. and a load of 21.18 N (2.16 kgf).

Regarding Requirement (11):

In the inventive golf ball, the ratio of the Deflection amount of the golf ball to the Deflection amount of the sphere is usually at least 0.85, preferably at least 0.87, and more preferably at least 0.88. At to the upper limit, the Deflection amount ratio is usually up to 0.95, preferably up to 0.93, and more preferably up to 0.92. With too low or too high a ratio, the ball when hit with a driver (W#1) may receive more spin and thus travel a less distance.

The effective means for designing the golf ball so as to meet requirement (11) is to set the hardness and thickness of the cover and the Deflection amount of the sphere in appropriate ranges.

The golf ball of the invention may be manufactured for use in tournaments by giving it a diameter and weight which conform with the Rules of Golf. That is, the ball may be produced to a diameter of not less than 42.67 mm and a weight of not greater than 45.93 g. As the upper limit of diameter, the ball diameter is preferably up to 44.0 mm, more preferably up to 43.5 mm, and most preferably up to 43.0 mm. As the lower limit of weight, the ball weight is preferably at least 44.5 g, more preferably at least 45.0 g, even more preferably at least 45.1 g, and most preferably at least 45.2

EXAMPLE

Examples of the invention and comparative examples are given below by way of illustration, and are not intended to limit the invention.

Examples 1-3 and Comparative Examples 1-6

Three-piece solid golf balls were manufactured. First the cores were produced by molding rubber compositions whose formulation is shown in Table 1 and vulcanizing at 157° C. for 15 minutes. Over the cores, intermediate layer materials and cover materials whose formulations are shown in Table 2 were injection molded in sequence.

The test results of the golf balls are shown in Table 3.

TABLE 1

| Core composition | Example | | | Comparative Example | | | | | |
|---|---|---|---|---|---|---|---|---|---|
| (pbw) | 1 | 2 | 3 | 1 | 2 | 3 | 4 | 5 | 6 |
| Polybutadiene A | 0 | 0 | 0 | 0 | 50 | 50 | 0 | 0 | 0 |
| Polybutadiene B | 0 | 0 | 0 | 0 | 50 | 50 | 0 | 0 | 0 |
| Polybutadiene C | 100 | 100 | 100 | 100 | 0 | 0 | 100 | 100 | 100 |
| Zinc acrylate | 26.6 | 24 | 22.9 | 26.6 | 21 | 21 | 26.6 | 22.9 | 26.6 |
| Peroxide 1 | 0.3 | 0.3 | 0.3 | 0.3 | 0.6 | 0.6 | 0.3 | 0.3 | 0.3 |
| Peroxide 2 | 0.3 | 0.3 | 0.3 | 0.3 | 0.6 | 0.6 | 0.3 | 0.3 | 0.3 |
| Antioxidant | 0.1 | 0.1 | 0.1 | 0.1 | 0.1 | 0.1 | 0.1 | 0.1 | 0.1 |
| Zinc oxide | 28.3 | 29.6 | 30 | 34.2 | 27.3 | 26.7 | 24 | 30 | 28.6 |
| Zinc salt of pentachlorothiophenol | 0.3 | 0.3 | 0.3 | 0.3 | 0 | 0 | 0.3 | 0.3 | 0.3 |
| Zinc stearate | 5 | 5 | 5 | 5 | 0 | 0 | 5 | 5 | 5 |

Polybutadiene A: trade name BR01 by JSR Corp.

Polybutadiene B: trade name BR11 by JSR Corp.

Polybutadiene C: trade name BR730 by JSR Corp.

Peroxide 1: dicumyl peroxide, trade name Percumyl D by NOF Corp.

Peroxide 2: 1,1-bis(t-butylperoxy)-3,3,5-trimethylcyclohexane, trade name Perhexa 3M-40 by NOF Corp.

Antioxidant: Nocrac NS-6 by Ouchi Shinko Chemical Industry Co., Ltd.

Zinc stearate: trade name Zinc Stearate G by NOF Corp.

TABLE 2

| | Composition (pbw) | | | | | | |
|---|---|---|---|---|---|---|---|
| | A | B | C | D | E | F | G |
| Surlyn 8120 | 75 | | | | | | 35 |
| Surlyn 7930 | | | | | 22.5 | | |
| AM7311 | | | | | 21 | | |
| AM7317 | | 50 | | | | | |
| AM7318 | | 50 | | | | | |
| Himilan 1706 | | | 50 | | | 25 | |
| Himilan 1605 | | | 50 | | | 50 | |
| Himilan 1855 | | | | | | | 35 |
| Surlyn 9945 | | | | | | 25 | |
| AN4318 | | | | | 26.5 | | 30 |
| Hytrel 3046 | | | | 100 | | | |
| Dynaron E6100P | 25 | | | | 30 | | |
| Behenic acid | 20 | | | | | | |
| Calcium hydroxide | 2.3 | | | | | | |
| Titanium oxide | | 5 | 5 | | | 4 | 5 |
| MFR (g/10 min) | 2.1 | 1.7 | 1.7 | 10 | 2.5 | 3 | 5 |

Surlyn 8120, 7930, 9945: ionomer resins by E. I. DuPont de Nemours and Company.

AM7311, 7317, 7318: ionomer resins by Dupont-Mitsui Polychemicals Co., Ltd.; 7311 is magnesium-neutralized ionomer, 7317 is zinc-neutralized ionomer with an acid content of 18%, 7318 is sodium-neutralized ionomer with an acid content of 18%

Himilan 1706, 1605, 1855: ionomer resins by DuPont-Mitsui Polychemicals Co., Ltd.

AN 4318: Nucrel by DuPont-Mitsui Polychemicals Co., Ltd.

Hytrel 3046: polyester elastomer by Dupont-Toray Co., Ltd.

Dynaron 6100P: hydrogenated polymer by JSR Corp.

Behenic acid: NAA222-S in bead form, by NOF Corp.

Calcium hydroxide: CLS-B by Shiraishi Industry Co., Ltd.

TABLE 3

| | | | Example | | | Comparative Example | | | | | |
|---|---|---|---|---|---|---|---|---|---|---|---|
| | | | 1 | 2 | 3 | 1 | 2 | 3 | 4 | 5 | 6 |
| Core | Outer diameter (mm) | | 37.60 | 37.60 | 37.60 | 36.10 | 38.00 | 38.00 | 37.60 | 37.58 | 37.60 |
| | Specific gravity ($g/cm^3$) | | 1.200 | 1.202 | 1.202 | 1.234 | 1.187 | 1.183 | 1.175 | 1.202 | 1.204 |
| | Deflection amount (mm) | | 3.61 | 4.24 | 4.50 | 3.60 | 3.96 | 4.00 | 3.60 | 4.50 | 3.60 |
| | Initial velocity (m/s) | | 77.3 | 77.1 | 77.0 | 77.3 | 76.7 | 76.7 | 77.3 | 77.0 | 77.3 |
| | Surface hardness (Shore D) | | 50 | 43 | 40 | 50 | 46 | 46 | 50 | 40 | 50 |
| Intermediate layer | Material | | A | A | A | A | B | C | D | E | A |
| | Specific gravity (g/cm3) | | 0.94 | 0.94 | 0.94 | 0.94 | 0.98 | 0.99 | 1.07 | 0.93 | 0.94 |
| | Sheet hardness (Shore D) | | 51 | 51 | 51 | 51 | 65 | 63 | 30 | 51 | 51 |
| | Thickness (mm) | | 1.28 | 1.28 | 1.28 | 1.65 | 1.25 | 1.22 | 1.28 | 1.28 | 1.28 |
| Sphere (core enclosed with intermediate layer) | Outer diameter (mm) | | 40.15 | 40.17 | 40.17 | 39.40 | 40.50 | 40.43 | 40.14 | 40.14 | 40.15 |
| | Deflection amount (mm) | | 3.45 | 4.03 | 4.28 | 3.42 | 3.42 | 3.46 | 3.70 | 4.30 | 3.50 |
| | Initial velocity (m/s) | | 77.6 | 77.4 | 77.3 | 77.4 | 77.4 | 77.2 | 76.9 | 76.7 | 77.6 |
| Cover | Material | | F | F | F | F | F | F | F | F | G |
| | Specific gravity (g/cm3) | | 0.97 | 0.97 | 0.97 | 0.97 | 0.97 | 0.97 | 0.97 | 0.97 | 0.96 |
| | Sheet hardness (Shore D) | | 63 | 63 | 63 | 63 | 63 | 63 | 63 | 63 | 48 |
| | Thickness (mm) | | 1.28 | 1.27 | 1.27 | 1.85 | 1.10 | 1.14 | 1.28 | 1.28 | 1.28 |
| Ball | Outer diameter (mm) | | 42.7 | 42.7 | 42.7 | 42.7 | 42.7 | 42.7 | 42.7 | 42.7 | 42.7 |
| | Weight (g) | | 45.3 | 45.3 | 45.3 | 45.3 | 45.3 | 45.3 | 45.3 | 45.3 | 45.3 |
| | Deflection amount (mm) | | 3.1 | 3.6 | 3.8 | 2.8 | 3.3 | 3.3 | 3.3 | 3.8 | 3.5 |
| | Initial velocity (m/s) | | 77.3 | 77.2 | 77.1 | 77.3 | 77.1 | 77.0 | 76.8 | 76.6 | 76.5 |
| Cover hardness − intermediate layer hardness (Shore D) | | | 12 | 12 | 12 | 12 | −2 | 0 | 33 | 12 | −3 |
| Sphere initial velocity − core initial velocity (m/s) | | | 0.30 | 0.30 | 0.30 | 0.1 | 0.70 | 0.50 | −0.40 | −0.30 | 0.30 |
| Sphere deflection amount/ core deflection amount | | | 0.96 | 0.95 | 0.95 | 0.95 | 0.86 | 0.86 | 1.03 | 0.96 | 0.97 |
| Cover thickness + intermediate layer thickness (mm) | | | 2.56 | 2.55 | 2.55 | 3.50 | 2.35 | 2.35 | 2.56 | 2.56 | 2.55 |
| Ball deflection amount/ sphere deflection amount | | | 0.90 | 0.89 | 0.89 | 0.82 | 0.96 | 0.95 | 0.89 | 0.88 | 1.00 |
| Flight performance | W#1 HS 40 m/s | Carry (m) | 187.1 | 186.6 | 185.7 | 186.8 | 186.4 | 185.9 | 184.0 | 183.5 | 183.6 |
| | | Total (m) | 198.5 | 199.2 | 200.2 | 196.2 | 197.3 | 197.0 | 194.8 | 196.9 | 193.1 |
| | | Spin (rpm) | 2846 | 2691 | 2602 | 2945 | 2892 | 2875 | 2958 | 2621 | 3152 |
| | | Flight distance | Excellent | Excellent | Excellent | Mediocre–Poor | Passable | Passable | Poor | Mediocre–Poor | Poor |
| Feel with W#1 | | | Good | Good | Good | Good | Good | Good | Good | Good | Good |
| Feel with putter | | | Good | Good | Good | Good | Poor | Poor | Good | Good | Good |
| Crack durability | | | Good | Good | Medio-cre | Good | Medio-cre | Good | Poor | Good | Good |
| Scuff resistance | | | Good | Good | Good | Good | Good | Good | Good | Good | Poor |

Flight Performance

Using a hitting robot equipped with a driver (W#1) club, the golf ball was hit at a head speed (HS) of 40 m/s. The carry, total distance and spin rate were measured. The W#1 club used was TourStage X500 (loft 10°) by Bridgestone Sports Co., Ltd. The flight distance is rated "Excellent" when the total distance is greater than or equal to 198.0 m, "Passable" when the total distance is from 197 m to less than 198.0 m, "Mediocre" when the total distance is from 196.0 m to less than 197.0 m, and "Poor" when the total distance is less than 196.0 m.

Feel with W#1 and Putter

A sensory test used a panel of ten amateur golfers with an ability to swing W#1 club at a head speed of 35 to 40 m/s. The ball was rated "Good" when seven or more golfers felt good and "Poor" when only four or less golfers felt good.

Crack Durability

Using a hitting robot equipped with a driver (W#1) club, the golf ball was repetitively hit at a head speed of 40 m/s. The number of strikes when the ball surface started crazing was counted. For each ball, three samples were tested and an average number was computed. It was converted to an index provided that the number of strikes on the ball of Example 2 until crazing was 100. The ball was rated "Good" when the index is equal to or greater than 95, "Mediocre" when the index is from 80 to less than 95, and "Poor" when the index is less than 80.

Scuff Resistance

Using a hitting robot equipped with a non-plated pitching sandwedge, the golf ball was once hit at a head speed of 40 m/s. The ball surface was visually examined. The ball was rated "Good" when the ball could be used again and "Poor" when the ball was no longer used.

The golf ball of Comparative Example 1, in which the total thickness of the intermediate layer and the cover is too large, receives too much spin and travels a shorter distance when hit with W#1.

The golf ball of Comparative Example 2, in which the intermediate layer is too hard, and the ratio of the Deflection amount of the sphere to the Deflection amount of the core is too low, gives a hard feel on putter shots and is less durable to cracking on repeated impact.

The golf ball of Comparative Example 3, in which the intermediate layer is too hard, and the ratio of the Deflection amount of the sphere to the Deflection amount of the core is too low, gives a hard feel on putter shots.

In the golf ball of Comparative Example 4, the intermediate layer is too soft, the ratio of the Deflection amount of the sphere to the Deflection amount of the core is too high, and the difference of the initial velocity (m/s) of the sphere minus the initial velocity (m/s) of the core is negative. Thus the ball of Comparative Example 4 gives a lower initial velocity, receives too much spin and travels only a short distance when hit with W#1, and is less durable to cracking on repeated impact.

The golf ball of Comparative Example 5, in which the difference of the initial velocity (m/s) of the sphere minus the initial velocity (m/s) of the core is negative travels a shorter distance.

The golf ball of Comparative Example 6, in which the cover hardness is lower than the intermediate layer hardness, receives too much spin and travels only a short distance when hit with W#1, and is less resistant to scuffing.

The invention claimed is:

1. A golf ball, comprising a core, an intermediate layer enclosing the core to form a sphere, and a cover enclosing the intermediate layer, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4):

(1) (Shore D hardness of the cover)−(Shore D hardness of the intermediate layer)>0, (2) (initial velocity of the sphere)−(initial velocity of the core)>0, (3) 0.90≦(Deflection amount of the sphere)/(Deflection amount of the core)≦1.00, and (4) the total of the thickness of the intermediate layer and the thickness of the cover is up to 3.0 mm, wherein said intermediate layer comprises (A) an ionomer resin comprising (a-1) an olefin/unsaturated carboxylic acid binary random copolymer and/or a metal ion neutralized product thereof and (a-2) an olefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-ionomeric thermoplastic elastomer in a weight ratio A/B between 100/0 and 50/50, wherein said intermediate layer further comprises:

(C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in said resin component and component (C), and wherein the ionomer resin (A) and the non-ionomeric thermoplastic elastomer (B) in a weight ratio A/B between 100/0 and 50/50 are 100 parts by weight.

2. The golf ball of claim 1 which further satisfies the following requirements (5) to (9):

(5) the thickness of the cover is from 0.5mm to 2.0 mm, (6) the Shore D hardness of the cover is from 55 to 70, (7) the thickness of the intermediate layer is from 0.5 mm to 1.6mm, (8) the Shore D hardness of the intermediate layer is from 40 to 60, and (9) the golf ball has an initial velocity of at least 76.5 m/s.

3. The golf ball of claim 1 which further satisfies the following requirement (10):

(10) the cover has a melt flow rate of at least 2 g/10 mm.

4. The golf ball of claim 1, wherein the weight ratio A/B is between 100/0 and 60/40.

5. The golf ball of claim 1, wherein 30≧(Shore D hardness of the cover)−(Shore D hardness of the intermediate layer)≧0.

6. The golf ball of claim 1, wherein 20≧(Shore D hardness of the cover)−(Shore D hardness of the intermediate layer)≧5.

7. The golf ball of claim 1, wherein 15≧(Shore D hardness of the cover)−(Shore D hardness of the intermediate layer)≧10.

8. The golf ball of claim 1, wherein (initial velocity of the sphere)−(initial velocity of the core)≧0.1.

9. The golf ball of claim 1, wherein (initial velocity of the sphere)−(initial velocity of the core)≧0.2.

10. The golf ball of claim 1, wherein 0.92≦(Deflection amount of the sphere)/(Deflection amount of the core)≦0.98.

11. The golf ball of claim 1, wherein 0.94≦(Deflection amount of the sphere)/(Deflection amount of the core)≦0.96.

12. The golf ball of claim 1, wherein the total of the thickness of the intermediate layer and the thickness of the cover is 1.5 to 3.0 mm.

13. The golf ball of claim 1, wherein the total of the thickness of the intermediate layer and the thickness of the cover is 2.0 to 2.8 mm.

14. The golf ball of claim 1, wherein the total of the thickness of the intermediate layer and the thickness of the cover is up to 2.4 to 2.6 mm.

15. The golf ball of claim 1, wherein the thickness of the cover is 0.9 to 1.6 mm.

16. The golf ball of claim 1, wherein the thickness of the cover is 1.1 to 1.3 mm.

17. The golf ball of claim 1, wherein the Shore D hardness of the cover is from 57 to 66.

18. The golf ball of claim 1, wherein the Shore D hardness of the cover is from 60 to 63.

19. The golf ball of claim 1, wherein the thickness of the intermediate layer is from 0.8 to 1.4 mm.

20. The golf ball of claim 1, wherein the thickness of the intermediate layer is from 1.1 to 1.3 mm.

21. The golf ball of claim 1, wherein the Shore D hardness of the intermediate layer is from 45 to 55.

22. The golf ball of claim 1, wherein the Shore D hardness of the intermediate layer is from 48 to 52.

23. The golf ball of claim 1, wherein the golf ball has an initial velocity of at least 76.8 m/s.

24. The golf ball of claim 1, wherein the golf ball has an initial velocity of at least 77.0 m/s.

25. The golf gall of claim 1, wherein the cover has a melt flow rate of at least 2.5 g/10 mm.

26. The golf ball of claim 1, wherein the cover has a melt flow rate of at least 3.0 g/10 mm.

27. The golf ball of claim 1, wherein the core has a Deflection amount of at least 3.0 mm and up to 6.0 mm.

28. The golf ball of claim 1, wherein the core has a Deflection amount of at least 3.3 mm and up to 5.0 mm.

29. The golf ball of claim 1, wherein the core has a Deflection amount of at least 3.6 mm and up to 4.6 mm.

30. The golf ball of claim 1, wherein the core has a specific gravity of at least 1.05 g/cm$^3$ and up to 1.35 g/cm$^3$.

31. The golf ball of claim 1, wherein the core has a specific gravity of at least 1.15 g/cm$^3$ and up to 1.25 g/cm$^3$.

32. The golf ball of claim 1, wherein the Shore D hardness on the core surface is at least 30 and up to 60.

33. The golf ball of claim 1, wherein the Shore D hardness on the core surface is at least 35 and up to 55.

34. The golf ball of claim 1, wherein the Shore D hardness on the core surface is at least 40 and up to 50.

35. The golf ball of claim 1, wherein the ball has a diameter of not less than 42.67 mm and up to 44.0 mm.

36. The golf ball of claim 1, wherein the ball has a weight of at least 44.5 g and not greater than 45.93 g.

37. A golf ball, comprising a core, an intermediate layer enclosing the core to form a sphere, and a cover enclosing the intermediate layer, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4):

(1) (Shore D hardness of the cover)−(Shore D hardness of the intermediate layer)>0, (2) (initial velocity of the sphere)−(initial velocity of the core)>0, (3) 0.90≦(Deflection amount of the sphere)/(Deflection amount of the core)≦1.00, and (4) the total of the thickness of the intermediate layer and the thickness of the cover is up to 3.0 mm, wherein 0.87≦(Deflection amount of the golf ball)/(Deflection amount of the sphere)≦0.93.

38. The golf ball of claim 37 wherein 0.88≦(Deflection amount of the golf ball)/(Deflection amount of the sphere)≦0.92.

* * * * *